United States Patent [19]

Robert et al.

[11] 4,087,151

[45] May 2, 1978

[54] PRINTED CIRCUIT CARD EDGE CONNECTOR WITH NORMALLING CONTACTS

[75] Inventors: Lawrence A. Robert, Richfield; Richard A. Gunderson, Eden Prairie, both of Minn.

[73] Assignee: Magnetic Controls Company, Minneapolis, Minn.

[21] Appl. No.: 800,731

[22] Filed: May 26, 1977

Related U.S. Application Data

[63] Continuation of Ser. No. 709,440, Jul. 28, 1976, abandoned.

[51] Int. Cl.[2] ..... H01R 33/30

[52] U.S. Cl. ..... 339/176 MP; 200/51.1

[58] Field of Search ..... 339/176 M, 176 MP, 17 L; 200/51.1

[56] References Cited

U.S. PATENT DOCUMENTS

| | | | |
|---|---|---|---|
| 3,231,848 | 1/1966 | Ruehlemann | 339/176 MP |
| 3,289,146 | 11/1966 | Tuchel | 339/176 MP |
| 3,335,398 | 8/1967 | Clewes | 339/176 MP |
| 3,903,385 | 9/1975 | Moyer | 339/176 MP |
| 3,976,850 | 8/1976 | Faber et al. | 200/51.1 |

*Primary Examiner*—Neil Abrams

*Attorney, Agent, or Firm*—Neil B. Schulte

[57] ABSTRACT

An edge connector for a printed circuit card that includes normalling contacts. The connector is designed to make circuit with the printed circuit card before breaking the normalling contacts by having two springable contacts positioned so that the printed circuit card must pass between them and against a first set of contact surfaces before it can reach and separate the normalling or second set of contact surfaces.

6 Claims, 6 Drawing Figures

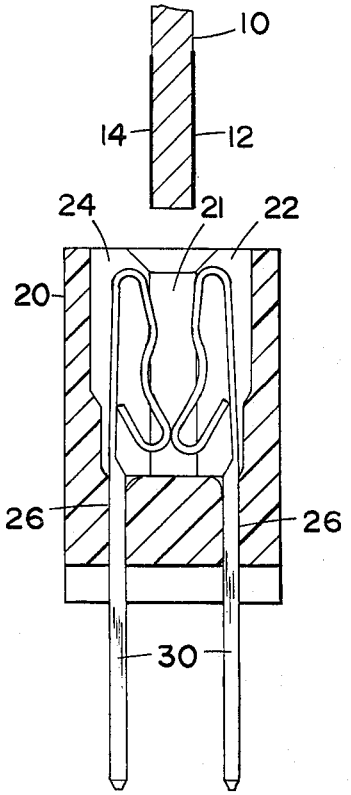
FIG. 1
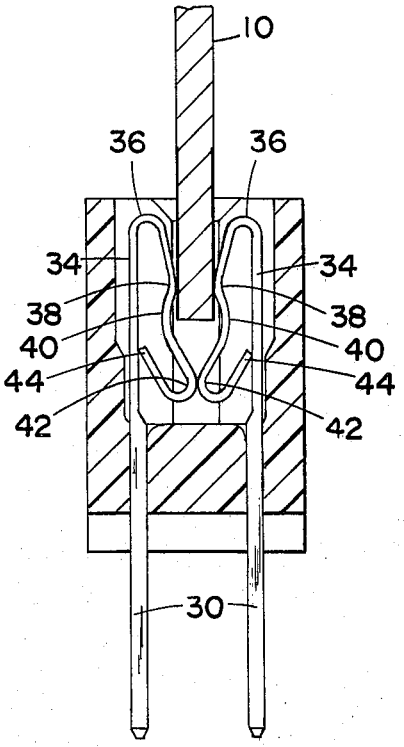
FIG. 2
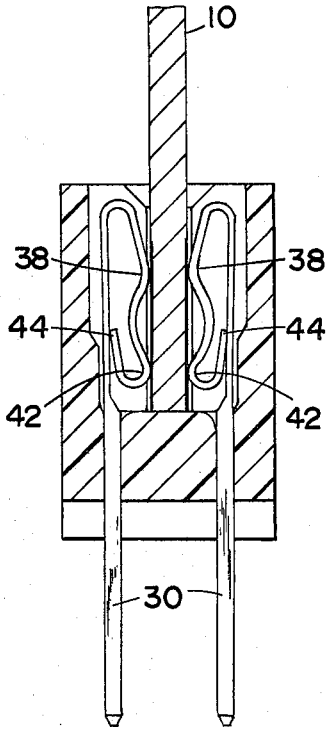
FIG. 3
FIG. 4
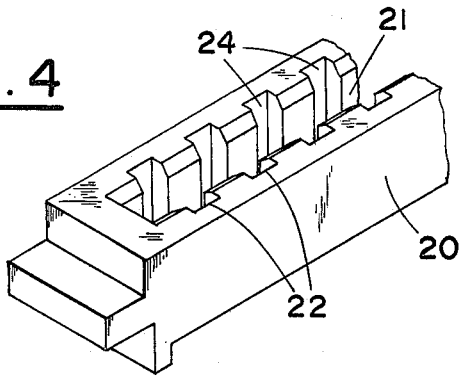

PRINTED CIRCUIT CARD EDGE CONNECTOR WITH NORMALLING CONTACTS

This is a continuation of application Ser. No. 709,440 filed July 28, 1976 now abandoned.

BACKGROUND OF THE INVENTION

In the prior art it is common to bring the circuits on a circuit board to a number of contact terminals positioned along one edge so that the card can be physically inserted into an edge connector to establish a plurality of separate circuits. In some arts, such as those related to telephone equipment, it is desirable that a through circuit be maintained in the edge connector when the card is not inserted. This is achieved by the use of separate normal through contacts in the connector. Some prior art devices use a spring loaded shorting bar which is pushed out of the way by the insertion of the printed circuit card. Other more elaborate mechanical devices are also employed by the prior art. However, they all suffer from the disadvantage that they do not reliably make the connection with the inserted printed circuit card before the normal connection is broken. This is particularly objectionable to the telephone industry where it is necessary to always maintain a continuous circuit to avoid the possible interruption of a circuit carrying voice or data signals. It would therefore be a significant improvement if one could have a reliable make-before-break edge connector for a printed circuit card. The present invention accomplishes this end.

BRIEF SUMMARY OF THE INVENTION

Briefly, our invention greatly simplifies the make-before-break edge connector concept by providing specially shaped spring contacts that form two contact areas which sequentially engage the edge of the circuit board. As the circuit card slides across the first contact area the electrical connections to the circuit card are firmly established. Only after these circuits are established can the circuit board be inserted further to separate the normal through contacts. The switching action is accomplished without complex mechanisms or separate springs and requires only a pair of contact springs of the shape disclosed herein. Because of the sliding action both the initial electrical contact area and the normalling contact areas are wiped clean with each use to insure long contact life.

An additional advantage is achieved by splitting each spring contact down the center. The two halves can then operate independently thus providing more reliable springing and seating action and electrical contact redundancy. It may therefore be seen that it is an object of our invention to provide an improved normal through make-before-break edge connector for a printed circuit card. Further objects and advantages will become apparent from the following detailed description and drawings.

BRIEF DESCRIPTION OF THE DRAWINGS

FIGS. 1, 2, and 3 show cross sectional views of the edge connector with the circuit card about to be inserted, partially inserted, and fully inserted, respectively.

FIG. 4 is a perspective view of a portion of one end of the housing that contains the spring contact elements.

DESCRIPTION OF THE PREFERRED EMBODIMENT

Figure 5:
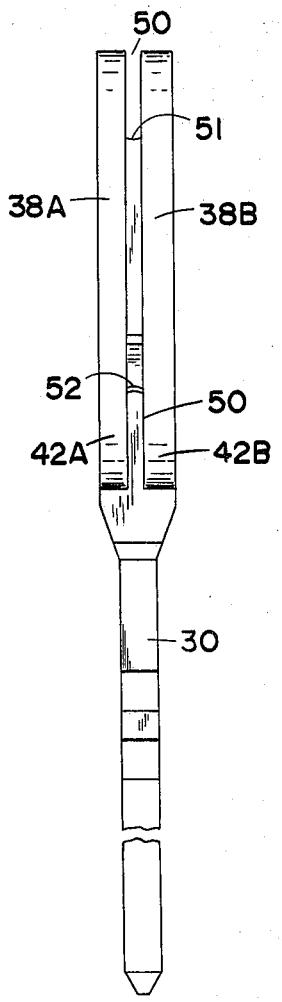
FIGS. 5 and 6 show respectively the circuit board side and the profile view of one of the contact elements.

In FIG. 1 a housing 20 is about to receive a printed circuit card 10. Card 10 has suitable printed circuit contacts 12 and 14 thereon of the type well known to those skilled in the art. Housing 20 may be constructed from any suitable non-conducting material as is also well known to those in the art. The housing 20 includes an opening 21 on its top side which receives the printed circuit card. The bottom side of housing 20 includes holes 26 through which a pair of contact elements 30 are inserted. The upper portions of the contact elements 30 are positioned in pockets 22 and 24 in opening 21 in the positions shown in FIG. 1.

Referring to FIG. 2, it may be seen that each contact element 30 includes a generally straight portion 34 that extends out the bottom of the housing to make suitable electrical connections, and also curves over at the top, at points 36, to form a hump shaped portion 38. The spring elements are then recurved at points 40 and extended out to form a second hump shaped portion 42. Humps 42 are formed farther out from straight portion 34 than humps 38. At the bottom of the humps 42 the springs curve back toward the straight portion 34 to rest there against at points 44. When printed circuit card 10 is inserted into the housing opening 21, as shown in FIG. 2, it first makes sliding contact with the hump shaped portions 38, thus firmly establishing electrical continuity with the circuits on the printed circuit card. Since humps 38 are already partially separated and since the contact elements tend to pivot at their lower ends near the point where they enter the holes 26, the top portions 36 of the springs move outward to accomodate card 10 without separating the normalling contact humps 42. It is only after the complete insertion of the card 10, as shown in FIG. 3, that the normalling contacts 42 are forcibly separated. In this position the normalling contacts 42 add their connections to the original connections at humps 38 so that the contact elements 30 each make a dual contact with terminals 12 and 14.

By curving the contact springs back to rest against the straight portion at point 44 the stiffness of the spring is increased which in turn increases the life of the spring and helps to insure the normalling of the two springs at point 42. However, this rest point is not necessary for the effective operation of the spring contacts as shown.

In FIG. 4 a perspective view of one end of the housing 20 is shown to better demonstrate the arrangement of the pockets 22 and 24 formed in the opening 21. Other housing arrangements would work as well provided they held the spring elements 30 in the positions shown.

Figure 6:
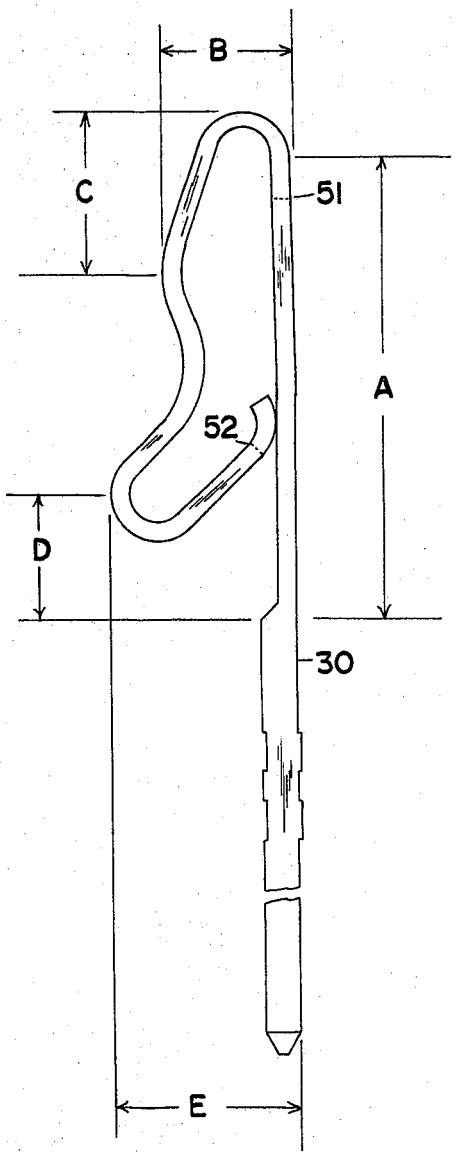

The shape of each of the contact elements may be seen in FIGS. 5 and 6. The preferred embodiment includes a split 50 that extends from point 51 near the top of the straight portion up and around through the two hump shaped portions and back to point 52. Split 50 allows the first hump shaped portion 38 to form two independent contacts 38A and 38B. It also allows the normalling contact 42 to form a pair of contacts 42A and 42B. With some freedom to move independently there is a greater assurance of a reliable connection between at least one of the numerous contact points on each side of the circuit board. It should be noticed that the circuit board wipes not only its primary contact areas 38 but also the normalling contacts 42 with each insertion so that the contact points are kept clean and a longer life is assured.

Of course, a number of minor modifications could be made to the invention without departing from the spirit and scope thereof such as a change in the exact position and length of split 50 or a slight change in the relative proportions of the spring. Accordingly, we intend to be bound only to the appended claims. However, the shape of the spring chosen for the preferred embodiment can be determined by the table of measurements that follow which give the relative sizes of the spring portions in inches but could serve as dimensionless ratios as well.

A — 0.325
B — 0.088
C — 0.115
D — 0.088
E — 0.133

We claim:

1. A printed circuit card edge connector with normalling make-before-break contacts comprising:

an insulating housing having an opening on the top side adapted to receive a printed circuit card with electrical contacts thereon, said opening including a plurality of pockets suitable to mount a plurality of contact elements therein;

at least one pair of contact elements mounted in said pockets so as to receive said card therebetween and make contact with the electrical contacts on the card, each of said elements having a shape that includes a first generally straight portion extending at its bottom end away from said opening and out of the housing through first and second separate openings to permit electrical connection thereto, each pair of elements having one of said first straight portions extending out of the housing through the first opening and the other of said first straight portions extending out of the housing through the second opening separate from and electrically insulated from said first opening, the top ends of said first straight portions being curved over to form first hump shaped contact surfaces, said pair of elements positioned in the pockets so as to have their first hump shaped contacts protruding toward each other, said element shape also including a recurved portion extending from the bottom of the curved portion and out from the straight portion a greater distance than the first hump shaped contact to form a second hump shaped portion, said pair of elements positioned in the pockets so as to always have their second hump shaped portions normally contacting each other except when forcibly separated by the insertion of a printed circuit card therebetween.

2. The connector of claim 1 including a second curved portion extending from the bottom of the recurved portion and back toward said straight portion to a position contiguous to said straight portion to stiffen the springing action of the second hump shaped portion.

3. The connector of claim 2 in which said contact element is split along its length in the areas of the first and second hump shaped portions and said curved and recurved portions so as to form dual contact points on the hump shaped portions.

4. The connector of claim 3 in which the straight portion of the contact elements pass through said first and second openings in the housing at the bottom of the pockets so as to establish a point of pivot for the top part of the straight portion.

5. The connector of claim 4 in which the contact elements are shaped in their unloaded relaxed condition in proportion to the following approximate relative lengths with said straight portion having a relative length of 0.325 above the point of pivot in the pocket, said first hump shaped portion having its contact surface at a point about 0.115 down from the top of the straight portion and about 0.088 out from the farthest back side of the straight portion, and said second hump shaped portion having its contact surface up about 0.088 from said point of pivot and out about 0.133 from the farthest back side of the straight portion.

6. The connector of claim 1 in which said contact element is split along its length in the areas of the first and second hump shaped portions and said curved and recurved portions so as to form dual contact points on the hump shaped portions.

* * * * *